United States Patent [19]

Saito

[11] 4,265,941

[45] May 5, 1981

[54] DIFFERENTIAL PRESSURE COATING SYSTEM

[75] Inventor: Hiroki Saito, Minami-ashigara, Japan

[73] Assignee: Fuji Photo Film Co., Ltd., Minami-ashigara, Japan

[21] Appl. No.: 52,513

[22] Filed: Jun. 26, 1979

[30] Foreign Application Priority Data

Jun. 26, 1978 [JP] Japan ..... 53/77267

[51] Int. Cl.[3] ..... B05D 3/00; B05D 3/12; C23C 13/08

[52] U.S. Cl. ..... 427/296; 118/50; 118/407; 427/350

[58] Field of Search ..... 427/296, 350; 118/50, 118/407

[56] References Cited

U.S. PATENT DOCUMENTS

| | | | |
|---|---|---|---|
| 2,681,294 | 6/1954 | Beguin | 118/410 X |
| 2,761,791 | 9/1956 | Russell | 118/410 X |
| 3,663,292 | 5/1972 | Herzhoff et al. | 118/50 X |
| 4,154,879 | 5/1979 | Choiaski | 118/50 X |

FOREIGN PATENT DOCUMENTS

| | | | |
|---|---|---|---|
| 2346164 | 3/1975 | Fed. Rep. of Germany | 427/296 |

*Primary Examiner*—Michael R. Lusignan

*Attorney, Agent, or Firm*—Sughrue, Rothwell, Mion, Zinn and Macpeak

[57] ABSTRACT

A bead coating system where negative pressures created for the marginal portions of a bead are higher than that created for the central portion of the bead. The pressure on the sides of the bead maintains the bead stable.

9 Claims, 4 Drawing Figures

DIFFERENTIAL PRESSURE COATING SYSTEM

BACKGROUND OF THE INVENTION

This invention relates to a method of coating a liquified coating compound on a belt-shaped flexible support (hereinafter referred to as "a web" when applicable).

One of the extensively employed methods known in the prior art of coating a liquified coating compound (hereinafter referred to as "a coating liquid" when applicable) on a web is a multi-layer slide bead coating method disclosed by U.S. Pat. No. 2,761,791 (Russell et al). In this method, a plurality of coating liquids running along a plurality of slopes are coated on a running web through a bead formed at the position where the liquids meet the web. In the method, it is essential to maintain the bead stable to satisfactorily coat the liquids on the web. However, when the coating rate is increased, it is difficult to maintain the bead stable.

U.S. Pat. No. 2,681,294 (Beguin et al) teaches that the bead can be advantageously maintained stable by creating a negative pressure on one side of the bead (upstream as viewed in the direction of advancement of the web) to provide a difference between the pressures on the two surfaces of the bead. However, the instability of the bead cannot be eliminated merely by solving the problems concerning the direction of advancement of the web and the pressure difference between the upper and lower surfaces of the bead. That is, the bead cannot be maintained stable without also solving the problem of three-dimensional balance including the stability of the bead in the direction of the width of the bead (same as the direction of the width of the web). According to the experiments made by the inventors, breakage of the bead begins at the marginal sides thereof in many cases. Accordingly, this problem must be solved before the coating rate is increased.

SUMMARY OF THE INVENTION

Accordingly, an object of this invention is to maintain the bead stable by taking its three-dimensional balance into account to apply a coating liquid on a web at a higher speed.

It is another object of this invention to provide for a system of applying a coating liquid on a web that is efficient and cost effective.

The foregoing objects of the invention are achieved by making the negative pressures created for the marginal portions of a bead higher than that created for the central portion of the bead. The pressures on the sides of the bead maintain the bead stable.

This invention will be described in detail with reference to the accompanying drawings.

DESCRIPTION OF THE PREFERRED EMBODIMENTS

Figure 1:
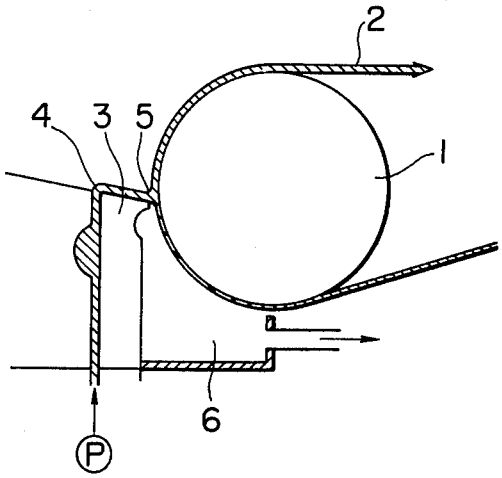
FIG. 1 PRIOR ART
FIG. 1 is a side view showing a conventional slide bead coating device.
Figure 2:
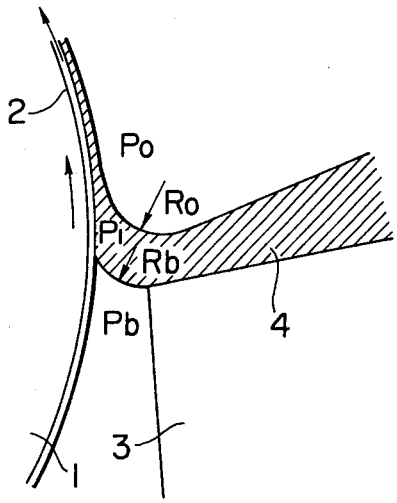
FIG. 2 is an enlarged view of a bead.

FIG. 1 is a side view of a conventional slide bead coating device. A web 2 is moved while being laid over a break-up roll 1 and a coating liquid 4 supplied from a slide hopper type coating head 3 is coated on the web 2 while forming a bead 5. A negative pressure chamber 6 is connected to a suction blower to maintain the pressure behind the bead 5 negative. FIG. 2 is an enlarged side view of the bead. The internal pressure of the bead can be considered to be substantially uniform. Therefore, on the upper and lower surfaces of the bead, $$P_0 - P_1 = \sigma / R_0 \quad (1)$$

$$P_1 - P_b = \sigma / R_b \quad (2)$$

therefore, $$P_0 - P_b = \sigma(1/R_0 + 1/R_b) \quad (3)$$

where, $P_0$=Atmospheric pressure, $P_1$=Bead internal pressure, $P_b$=Bead back pressure (the pressure in the negative pressure chamber), $\sigma$=The surface tension of the coating liquid, $R_0$=The radius of curvature of the upper surface of the bead (the sign being positive when the upper surface is downwardly convex), and $R_b$=The radius of curvature of the lower surface of the bead (the sign being positive when the lower surface is downwardly curves).

According to the results of observation, in ordinary coating conditions, $R_0 > 0$ $R_b > 0$ Therefore, from the equation (3)

$$P_0 - P_b > 0 \quad (4)$$

Thus, the effectiveness of the aforementioned U.S. Pat. No. 2,681,294 can be theoretically ascertained.

In general, as the degree of vacuum in the negative pressure 6 in FIG. 1 is increased, the stability of the bead is improved and therefore a thin layer of coating liquid can be readily formed on the web at high speed. However, if the degree of vacuum is increased to a value higher than a certain value, then the bead may be broken by being pulled downwardly. Accordingly, the most suitable degree of vacuum in the chamber 6 is, in general, obtained analytically from the results of experiments.

As a result of various experiments, the inventors have found that breakage of the bead begins at the sides thereof; that is, the bead is cut while shrinking widthwise. It is well known in the art that if the thickness of the side portions of the bead is increased, the stability of the bead may be improved. However, this method is not practical, because the amount of loss in the side portions of the manufactured web is increased. Also, the drying capacity must be increased to the extent that the heavily coated portion can be sufficiently dried.

In this invention, the atmospheric pressure for the middle portion of the bead is higher than the negative pressures for both side portions of the bead, whereby the tendency for the side portions of the bead to shrink widthwise is reduced and the bead is stably maintained even in high-speed thin layer coating.

Figure 3:
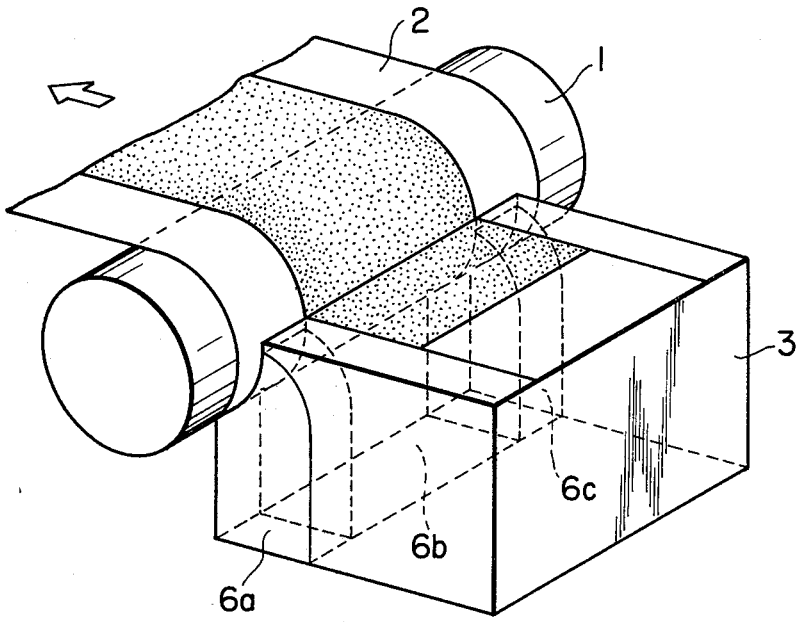
FIGS. 3 and 4 are perspective views showing examples of a slide bead coating device according to this invention.

FIG. 3 is a perspective view, with parts cut away, showing one embodiment of a slide bead coating device according to the invention. In FIG. 3, components designated by reference numerals 1 through 5 are the same as those of the conventional slide bead coating device as shown in FIG. 1. The specific feature of this embodiment resides in having one negative pressure chamber 6 employed to maintain the pressure behind the bead negative in the conventional device but, according to the invention the chamber 6 is divided into three chambers 6*a*, 6*b*, and 6*c*. The degree of vacuum in each of the two side chambers 6*a* and 6*c* is made higher than that in the central chamber 6*b*.

Accordingly, the pressures applied to the marginal portions of the bead are set to a value between the degree of vacuum in the negative pressure chambers 6*a* and 6*c* provided at both ends and atmospheric pressure. The value is freely adjustably according to the degrees of vacuum in the chambers 6*a* and 6*c*. The degree of vacuum in the central chamber 6*b* can be determined independently of those in the two end chambers 6*a* and 6*c*. Therefore, damage of the bead due to the higher degree of vacuum in the central portion of the bead can be prevented. The tendency of shrinking the side portions of the bead can also be prevented, and the bead can be maintained stable.

Figure 4:
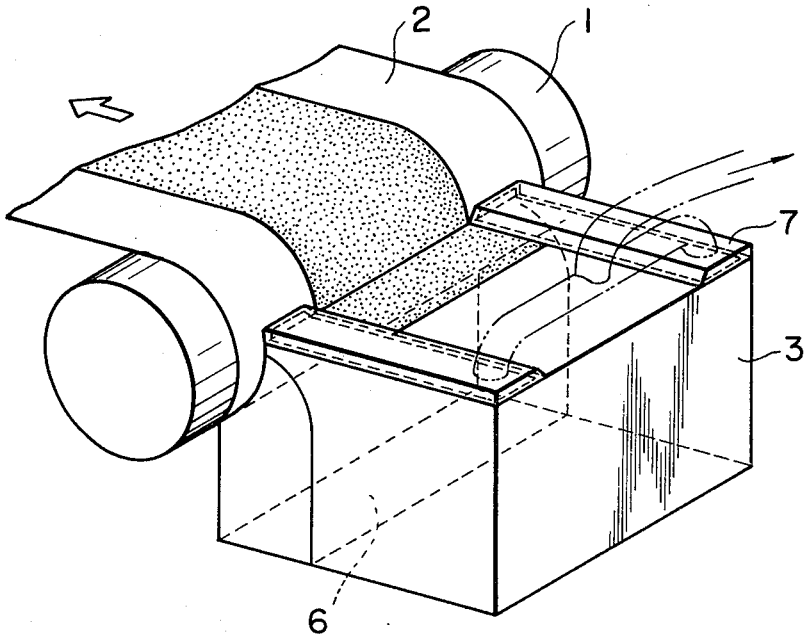

This invention is not limited to the above-described example. That is, the technique of reducing the pressures applied to the marginal portions of the bead can be variously modified. For instance, as shown in FIG. 4, the suction may be carried out through slots to effectively reduce the pressures applied to the marginal portions of the bead. Furthermore, the negative pressure chambers may be formed so that they surround the marginal portions of the bead (not shown).

This invention is applicable not only to the above-described slide bead coating method but also any coating method in which formation of a bead is essential.

As is apparent from the above description, according to the invention a bead is maintained stable in the bead coating method. The effects of the invention are significant as described below:

(1) The degree of stability of a bead in a bead coating method is increased, and therefore the coating can be achieved more stably.

(2) Even if the coating speed is changed, the bead can be stabilized in response to the change of the coating speed, and therefore the coating speed can be increased.

(3) Even if the amount of coating is changed, the bead can be stabilized in response to the change of the amount of coating, and therefore the thickness of a coated layer can be made thinner.

(4) The bead can be stabilized without increasing the thickness of the marginal portions of the bead, and therefore the drying speed can be substantially increased.

The effects of the invention will be more concretely described with reference to the following comparative example:

EXAMPLE

A single layer of photographic emulsion (with a viscosity of 40 cp and a surface tension of 28 dyne/cm) was coated on a web by using a slide bead coating device as shown in FIG. 3. The flow rate of the emulsion was 20 cc/cm. min. Under various bead back pressures, first the coating was done at low rate, and then the coating rate was gradually and continuously increased. During this operation, the coating rate at which the bead is broken (called as "a critical coating rate") was detected. The results are as indicated in Tables 1 and 2.

TABLE 1

| | (With Conventional Device) | | |
|---|---|---|---|
| Bead back pressure ($P_b$) | Critical coating rate | Amount of coating | Remarks |
| −40 mm/Aq | 90m/min. | 22.2 cc/m$^2$ | |
| −50 mm/Ag | 150m/min. | 13.3 cc/m$^2$ | |
| −55 mm/Aq or less | — | — | The bead was broken by the large back pressure |

TABLE 2

| | (With Device of the Invention) | | | |
|---|---|---|---|---|
| Bead back pressure (central portion) | Bead back pressure (both end Portions) | Critical coating rate | Amount of coating | Remarks |
| −40 mm/Aq | −60 mm/Aq | 120 m/min | 16.7 cc/m$^2$ | |
| | −80 mm/Aq | 230 m/min | 8.7 cc/m$^2$ | |
| −50 mm/Aq | −60 mm/Aq | 190 m/min | 10.5 cc/m$^2$ | |
| | −80 mm/Aq | 270 m/min | 7.4 cc/m$^2$ | |
| −55 mm/Aq | — | — | — | Bead was broken. |

As is clear from the comparison of Table 1 with Table 2, the coating rate in the coating method according to the invention, in which the negative bead back pressure is increased for the both end portions of the bead, is increased by 50 to 100% of that in the conventional coating method, and accordingly the thickness of the applied layer is much thinner.

It is apparent that modifications to this technique can be made without departing from the essential aspects of this invention.

What is claimed is:

1. A method of coating a web with a bead of coating material comprising the steps of feeding a supply of coating material onto said web to form a bead, applying a first negative pressure at position to be rear of the point of application of said coating material and, applying a second pressure, lower than said first negative pressure, at marginal side portions of the bead at the point of application of said coating material on to said web.

2. The method of claim 1 further comprising the step of establishing an equal second pressure on both marginal side portions of the bead.

3. The method of claims 1 or 2 wherein said second pressure is applied surrounding the marginal side portions of the bead.

4. The method of claims 1 or 2 wherein said first and second pressures are applied in a vacuum chamber having a central chamber for said first pressure and a pair of peripheral chambers for said second pressure.

5. The method of claim 4 wherein said peripheral chambers are disposed on respective sides of said central chamber.

6. The method of claim 4 wherein said peripheral chambers are disposed above said central chamber.

7. In an apparatus for coating a web with a coating material to form a bead thereon including means to apply a negative pressure to a central portion of the bead during application of said coating material, the improvement comprising, second means for applying a lower pressure than said negative pressure to marginal portions of said bead.

8. The apparatus of claim 7 wherein said means comprises a vacuum chamber divided into a central chamber and a pair of side chambers adjacent to said central chamber.

9. The apparatus of claim 7 wherein said means comprises a vacuum chamber having a central chamber and a pair of peripheral chamber disposed above said central chamber.

* * * * *